US012000648B2

(12) United States Patent
Edake

(10) Patent No.: US 12,000,648 B2
(45) Date of Patent: Jun. 4, 2024

(54) MECHANISM FOR APPLIANCE DRAWER

(71) Applicant: WHIRLPOOL CORPORATION, Benton Harbor, MI (US)

(72) Inventor: Mahesh Edake, Pune (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 13 days.

(21) Appl. No.: 17/543,161

(22) Filed: Dec. 6, 2021

(65) Prior Publication Data

US 2023/0175767 A1 Jun. 8, 2023

(51) Int. Cl.
*F25D 25/02* (2006.01)
*A47B 88/437* (2017.01)
*F25D 23/06* (2006.01)

(52) U.S. Cl.
CPC ..... *F25D 25/025* (2013.01); *F25D 23/067* (2013.01)

(58) Field of Classification Search
CPC ..... F25D 25/025; F25D 23/02; F25D 23/021; F25D 23/067; F36D 23/067; A47B 2210/175; A47B 88/487; A47B 88/493; A47B 88/437; A47B 88/57
See application file for complete search history.

(56) References Cited

U.S. PATENT DOCUMENTS 4,121,878 A * 10/1978 Lokken ..... A47B 88/467 312/334.45
4,615,095 A * 10/1986 Bessinger ..... A47B 88/467 312/333
5,040,856 A * 8/1991 Wilkins ..... F25D 25/025 312/334.21
5,785,400 A * 7/1998 Grieser ..... A47B 88/467 312/348.4
7,712,852 B2 * 5/2010 Choi ..... F25D 25/025 312/301
8,328,302 B2 * 12/2012 Kim ..... A47B 88/493 312/334.45
8,403,437 B2 * 3/2013 Bergmann ..... F25D 25/021 312/334.1
8,607,588 B2 * 12/2013 Oh ..... F25D 25/025 62/465
9,033,437 B2 * 5/2015 Klitzing ..... A47B 88/437 312/334.27

(Continued)

FOREIGN PATENT DOCUMENTS

CN 104215019 A 12/2014
CN 105402986 A 3/2016

(Continued)

*Primary Examiner* — Kimberley S Wright
(74) *Attorney, Agent, or Firm* — BROOKS KUSHMAN, P.C.

(57) ABSTRACT

A refrigerator drawer including a drawer and a rail member extending in a first direction and a lip extend in a second direction from the rail member. A first roller disposed between the rail member and the rear wall of the drawer. An end cap may be fixed to an inner liner of a refrigerator and may include a front wall, a rear wall, and an inner wall. A track extends from the inner wall and includes an upper portion and a lower portion, the lower portion configured to carry the first roller. A second roller is fixed to the inner wall of the end cap and is rotatable so that the sliding member moves along the second roller.

17 Claims, 9 Drawing Sheets

(56) References Cited

U.S. PATENT DOCUMENTS

| | | | | |
|---|---|---|---|---|
| 9,212,848 | B2 | 12/2015 | Kendall et al. | |
| 10,563,912 | B1 * | 2/2020 | Kumar | A47B 88/487 |
| 10,571,186 | B2 * | 2/2020 | Lee | F25D 23/067 |
| 2005/0156494 | A1 * | 7/2005 | Bergmann | A47B 88/493 312/404 |
| 2010/0024463 | A1 * | 2/2010 | Park | F25D 23/021 62/340 |
| 2011/0018414 | A1 * | 1/2011 | Kim | F25D 25/025 312/402 |
| 2011/0219808 | A1 * | 9/2011 | Oh | F25D 25/025 62/465 |
| 2012/0273504 | A1 * | 11/2012 | Rackley | F25D 25/025 220/592.02 |
| 2013/0257253 | A1 * | 10/2013 | Haltmeyer | F25D 25/025 312/404 |
| 2013/0257254 | A1 * | 10/2013 | Austin | F25D 25/025 312/404 |
| 2017/0198963 | A1 * | 7/2017 | Hanson | F25D 25/025 |
| 2019/0041123 | A1 * | 2/2019 | Lee | F25D 25/025 |
| 2020/0224959 | A1 * | 7/2020 | Wantland | F25D 25/025 |
| 2021/0293471 | A1 * | 9/2021 | Yang | E05F 5/10 |

FOREIGN PATENT DOCUMENTS

| | | | |
|---|---|---|---|
| CN | 211476429 | U | 9/2020 |
| KR | 20030081521 | A | 10/2003 |
| KR | 20160136659 | A | 11/2016 |

* cited by examiner

MECHANISM FOR APPLIANCE DRAWER

TECHNICAL FIELD

The present disclosure relates to assemblies for translating components including drawers or trays for use in a household appliance such as a refrigerator.

BACKGROUND

Refrigerators may include a variety of storage components that may be moved between a closed position and an open position. Such components can include bins, trays, pans, or the like and can be disposed within an interior of both a fresh food compartment and a freezer compartment. These components may be mounted to an inner liner of the refrigerator by one or more tracks or guides.

SUMMARY

According to one embodiment, a refrigerator drawer assembly is provided. The refrigerator drawer assembly may include a drawer body, a sliding member, first and second rollers, an end cap, and a track. The drawer body may define a receptacle and may include a first side and a second side that may collectively form the receptacle. The sliding member may extend from the first side of the drawer body away from the receptacle. The sliding member may include a first portion that may extend in a first direction between a rear wall of the drawer body and a front wall of the drawer body. The lip may extend in a second direction, that may be substantially orthogonal to the first direction, from the rail member. The first roller may be disposed between the rail member of the first sliding member and the rear wall of the drawer body. The end cap may be configured to be fixed to an inner liner of a refrigerator and may include a front wall, a rear wall, and an inner wall that may extend therebetween. The track may extend from the inner wall and may include an upper portion and a lower portion. The upper portion and the lower portion may each extend in the first direction between the front wall and the rear wall. The lower portion may be configured to carry the first roller.

According to another embodiment, a refrigerator drawer assembly is provided. The refrigerator drawer assembly may include a drawer body, a rail, a first stop, a first roller, an end cap, a track, and a second roller. The drawer may define a receptacle and the rail may be integral with a sidewall of the drawer body and may extend in a first direction between a rear wall of the drawer body and a front wall of the drawer body. The rail may define a channel and the first stop may be integral with the sidewall of the drawer body. The first roller may be disposed between an end of the rail and the rear wall of the drawer body. The end cap may be configured to be fixed to an inner liner of the refrigerator and may include an inner wall that may be configured to be arranged substantially parallel to the sidewall of the drawer body. The track may extend from the inner wall of the end cap and may include an upper portion and a lower portion. The upper portion and the lower portion of the track may each extend substantially in the first direction. The second roller may be fixed to the inner wall of the end cap and may be configured to rotate. As the drawer body moves in an opening direction towards a fully open position, the channel may be configured to move along the second roller as the second roller rotates. When the drawer assembly is disposed in the fully open position, the first stop may engage the second roller to prevent the drawer body from moving in the first direction beyond the fully open position.

According to yet another embodiment, a refrigerator is provided. The refrigerator may include an inner liner, an end cap assembly, a drawer body, a rail, a first roller and a second roller. The inner liner may include a first lateral wall, a second lateral wall, and a rear wall that may extend therebetween. The inner liner may form a refrigerated compartment and the first lateral wall and the second lateral wall may be spaced apart from one another in a lateral direction. The rear wall may be spaced apart from a front portion of the refrigerated compartment in a depth direction. The end cap assembly may be fixed to the inner liner and may include an inner wall, a track and the first roller. The track may be integral to the inner wall and may include an upper portion and a lower portion that may each extend in the depth direction. The first roller may be rotatably fixed to the inner wall. The drawer body may define a receptacle and may be configured to move in the depth direction. The rail may be integral with a sidewall of the drawer body and may extend in the depth direction and may define a channel. The channel may be configured to receive at least portions of the first roller. The second roller may be rotatably fixed to the sidewall of the drawer body and the lower portion of the track may be configured to support the second roller. The rail may form a rear stop and a front stop and the rail may be configured to guide the drawer body along the end cap assembly as the drawer body moves in the depth direction between a fully closed position, in which the front stop engages a portion of the end cap assembly and a fully open position, in which the rear stop engages another portion of the end cap assembly.

DETAILED DESCRIPTION

Figure 1:
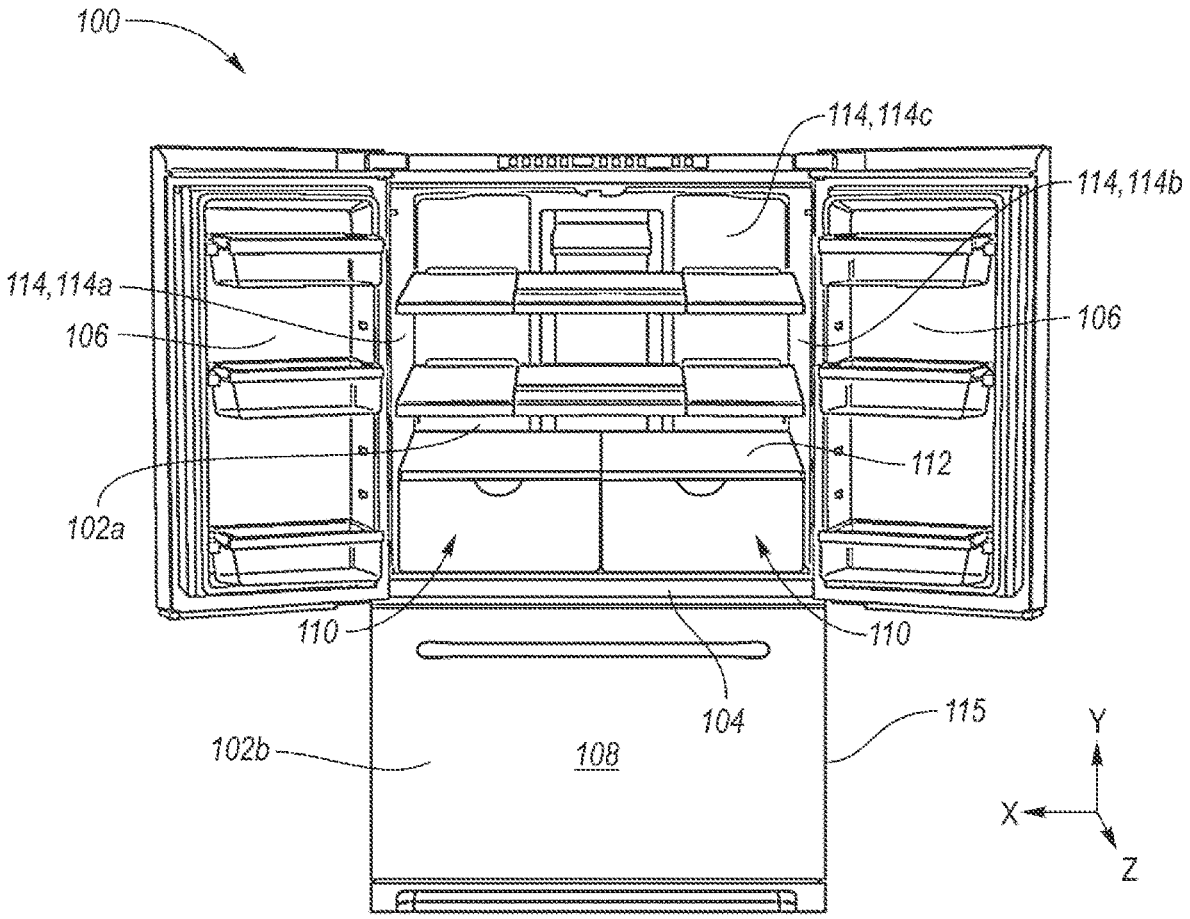
FIG. 1 illustrates a front-plan view of an exemplary refrigerator provided with drawers disposed in a closed position.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within ±0%, 0.1%, 0.5%, 1%, 2%, 3%, 4%, 5% or 10% of the value or relative characteristic.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Generally refrigerators may include a number of compartments such as drawers including crisper drawers or beverage drawers that may be translated between an open position and a closed position. Known drawers have several drawbacks. As an example, known drawers may shift or wobble laterally due to lateral clearances between fixed portions of the drawer the moveable drawer body. Drawers provided with less clearance between the fixed portions and the moveable drawer may resolve the wobbling issue but may result in increased forces to move the drawer between the open and closed positions. As another example, the force required to move the drawer between the open and closed positions may be relatively constant and as such the user may not know how far to move the drawer body with respect to the open and closed positions. Accordingly, the user may move the drawer body into end stops of the drawer body at a relatively high force. Over time, moving the drawer body into the end stops may cause undue wear and degradation of the drawer assembly.

The present disclosure aims to address one or more of the above-mentioned problems.

Referring generally to the figures, a drawer assembly 110 for use in a refrigerator 100 is provided. The drawer assembly 110 may include a drawer body 116 that may define one or more receptacles 118 configured to receive and store a number of food or beverage items. The drawer body 116 may include a rear wall 120, a front wall 122, and a pair of sidewalls 124 that may each extend between the front wall 122 and the rear wall 120. A rail 126 may be formed integral to the sidewall 124 of the drawer body 116 and may extend in a direction between the front and rear walls 120, 122. In one or more embodiments, the rail 126 may define a channel 128 that may be configured to guide or stabilize movement of the drawer body 116 with respect to a lateral or x-direction.

The drawer body 116 may be configured to move, with respect to a number of end cap 132, between an open position, in which the receptacle 118 is accessible, and a closed position, in which the receptacle 118 is not accessible. One or more rollers 130 may be rotatably fixed to the sidewall 124 and the roller 130 may be configured to move along one or more portions of the end cap 132, such as a track 134. As an example, the end cap 132 may be fixed to an inner periphery of the refrigerator 100 and may be arranged substantially parallel to the sidewall 124 of the drawer body 116. The track 134 may include an upper portion 136 and a lower portion 138 that may each be spaced apart from one another in a vertical or z-direction. The end cap 132 may include a second roller 140 that may be rotatably fixed to an inner wall 142 of the end cap 132. The second roller 140 may be configured to support the rail 126 of the drawer body 116. In one or more embodiments, the channel 128 may be configured to receive portions of the second roller 140 to guide or stabilize movement of the drawer body 116 with respect to a lateral or x-direction.

In one or more embodiments, the rail 126 and one or more portions of the track 134 may define a number of stops that may each be configured to constrain the drawer body 116 with respect to the end cap 132. As an example, a front distal portion 143 of the rail 126 may form a first stop 144 that may be configured to engage the second roller 140 to inhibit movement of the drawer body 116 once the drawer body 116 reaches the closed position. Alternatively or additionally, the rail 126 may include or more protrusions 146, 148 that may form a second stop 150 configured to inhibit movement of the drawer body 116 in the depth direction or z-direction. In one or more embodiments, the upper portion 136 may form a third stop 152 that may be configured to prevent vertical movement of the drawer body 116 by engaging the first roller 130, or the rail 126, or both.

FIG. 1 generally shows the refrigerator 100. The refrigerator may be of the French-Door Bottom Mount type, but it is understood that this disclosure could apply to any type of refrigerator, such as a side-by-side, two-door bottom mount, or top-mount type. As shown in FIG. 1, the refrigerator 100 may include a number of storage compartments 102. The storage compartments 102 may include a first internal storage chamber or a refrigerated compartment 102*a*, and a freezer compartment 102*c*. The convertible storage compartment 102*b*, may be disposed between the refrigerator compartment 102*a* and the freezer compartment 102*c*. However, the compartments 102 may be arranged in a variety of arrangements. Each of the compartments 102 may be divided by a mullion or divider 104 configured to insulate the compartments from one another for independent temperature control. Additionally, one or more of the compartments 102 may be controlled to adjust in temperature such that the compartments 102 may be implemented to store frozen or fresh items.

As shown, the fresh food compartment doors are designated 106, and the freezer door is designated 108. It may also be shown that the refrigerated compartment 102*a* may only have one door 106. As example, each of the compartments 102 divided by seals that may interact with the mullions 104 to insulate the compartments 102 from each other. Accordingly, the refrigerator 100 may be flexibly implemented in a variety of configurations.

The compartments 102 may be formed or at least partially defined by an inner liner 114 that may be surrounded by an outer wrapper 115 that may form the outer surfaces of the refrigerator 100. The inner liner 114 may include first and second lateral walls 114*a*, 114*b* and a rear wall 114*c* that may extend therebetween. The first and second lateral walls 114*a*, 114*b* may be spaced apart from one another in a width direction or x-direction. Front portions of the first and second lateral walls 114*a*, 114*b*, near where the doors 106 are fixed may be spaced apart from the rear wall 114*c* of the inner liner 114 in a depth direction or z-direction. The vertical direction or y-direction is indicated by the three-dimensional axis shown in FIG. 1.

Figure 2:
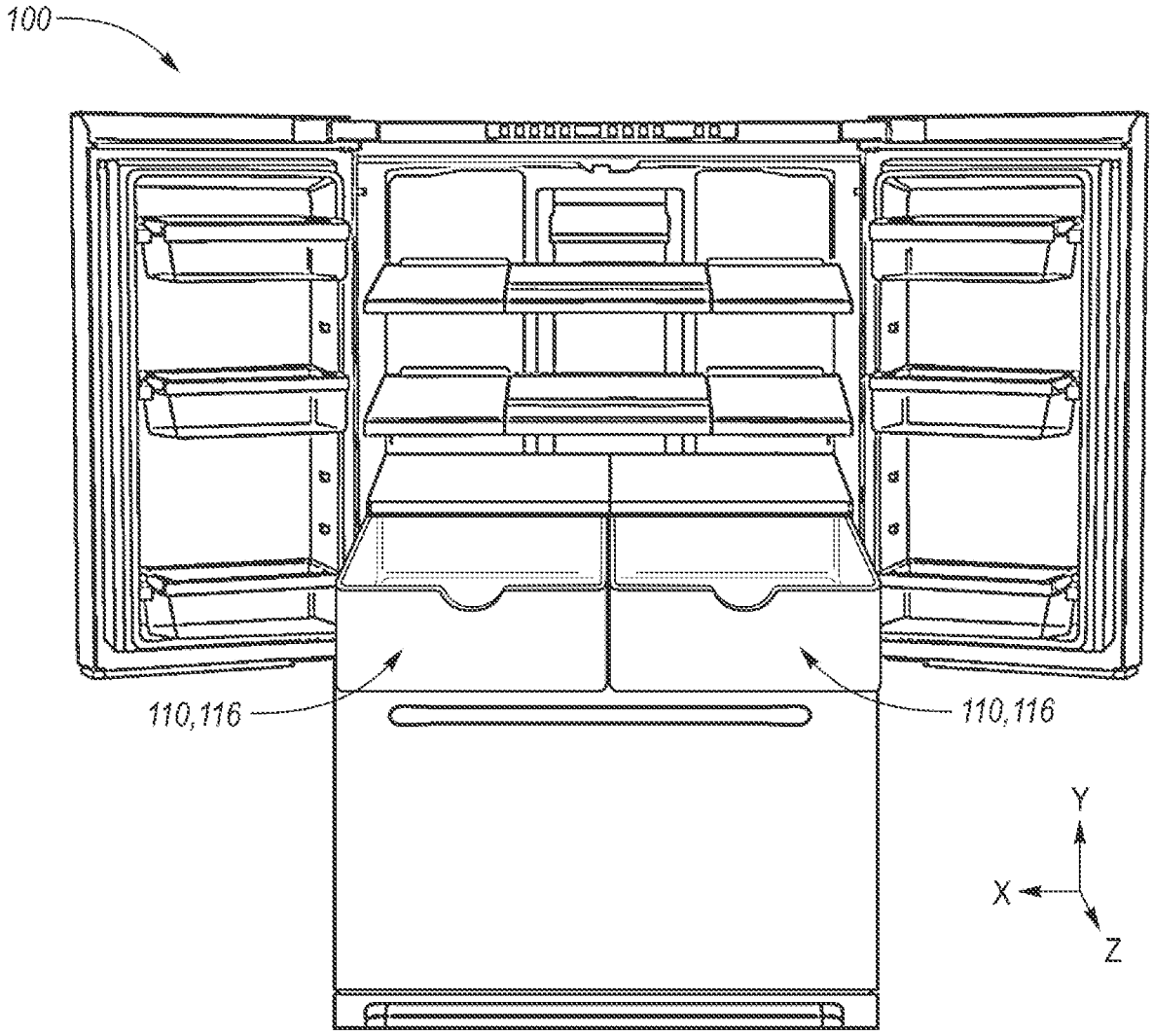
FIG. 2 illustrates a front-plan view of an exemplary refrigerator provided with drawers disposed in an open position.

The refrigerator 100 may include a number of drawer assemblies 110 that may be configured to house various perishable or non-perishable items such as food or beverages. The drawer assemblies 110 may be covered by a shelf or lid 112. In one or more embodiments, the lid 112 may be transparent so that one may view items stored in the drawer assemblies 110. The drawer assembly 110 may include the drawer body 116 that may be moved between the closed position and the open position (FIG. 2). The drawer assemblies 110 may be pantry drawers that may be temperature-controlled and specifically configured to store items at a different e.g., lower temperature than other items stored in the refrigerator. The drawer assemblies 110 may also be configured as crisper drawers or other types of drawers.

Figure 3:
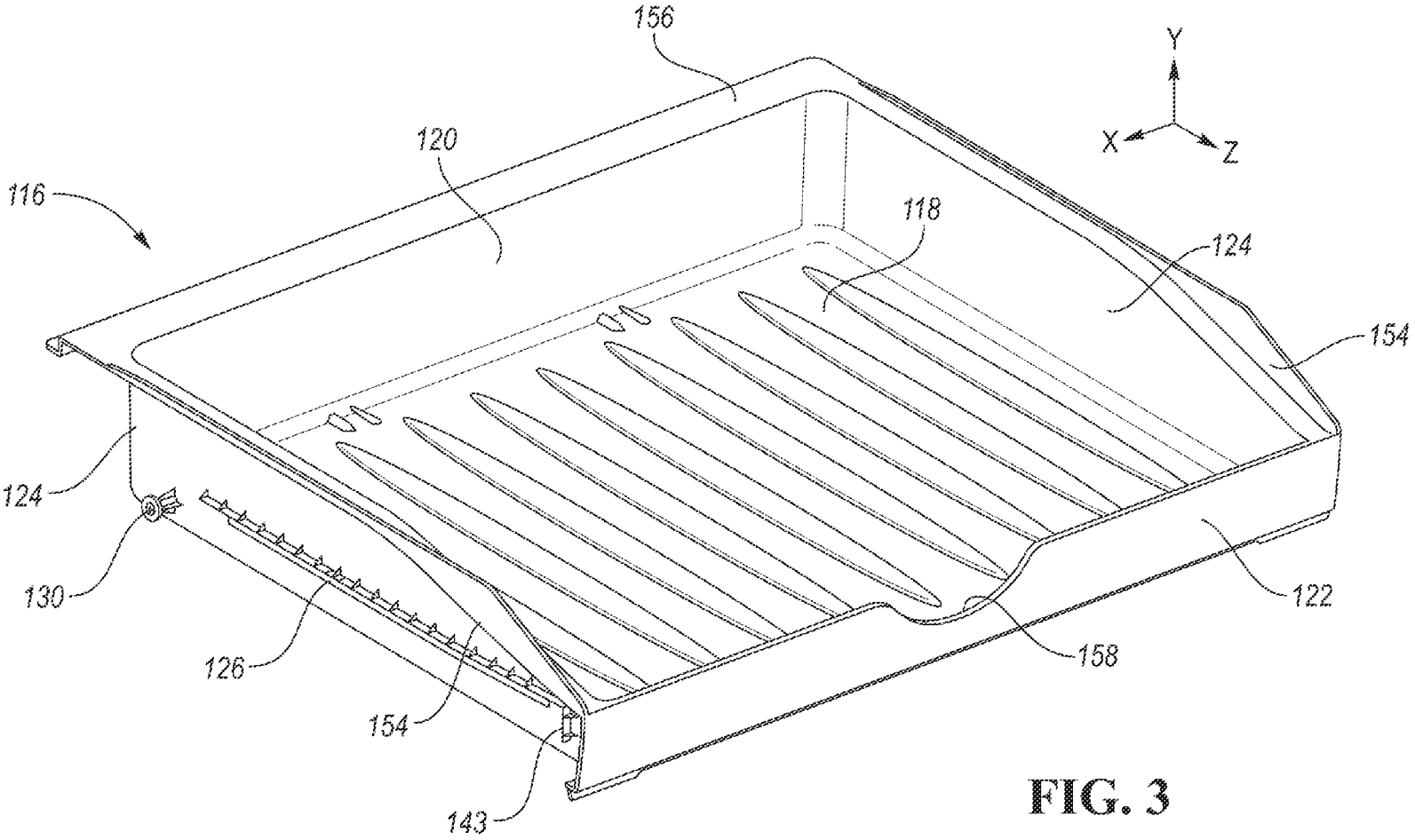
FIG. 3 illustrates a top-perspective view of an exemplary drawer body.

FIG. 3 illustrates a top-perspective view of the drawer body 116 according to one or more embodiments. As described above, the drawer body may include the rear wall 120 and the front wall 122 that may be connected to one another by the sidewalls 124. The front wall 122 may be positioned closer to the refrigerator doors 106 than the rear wall 114*c* of the inner liner 114 (FIGS. 1-2). As an example, one or more of the sidewalls 124 may be tapered so that the height of a front portion of the sidewalls 124 is less than the height of a rear portion of the sidewalls 124. A side flange 154 may extend in the lateral direction from each of the sidewall 124 and a rear flange 156 may extend from the rear wall 120 of the drawer body 116. In one or more embodiments, the front wall 122 may define a notch 158 that may allow a user to grasp the drawer body 116 to move the drawer body 116 between the open and closed positions. Alternatively or additionally, a separate or integrally molded handle (not illustrate) may be disposed on or formed with the front wall 122 of the drawer body.

Figure 4:
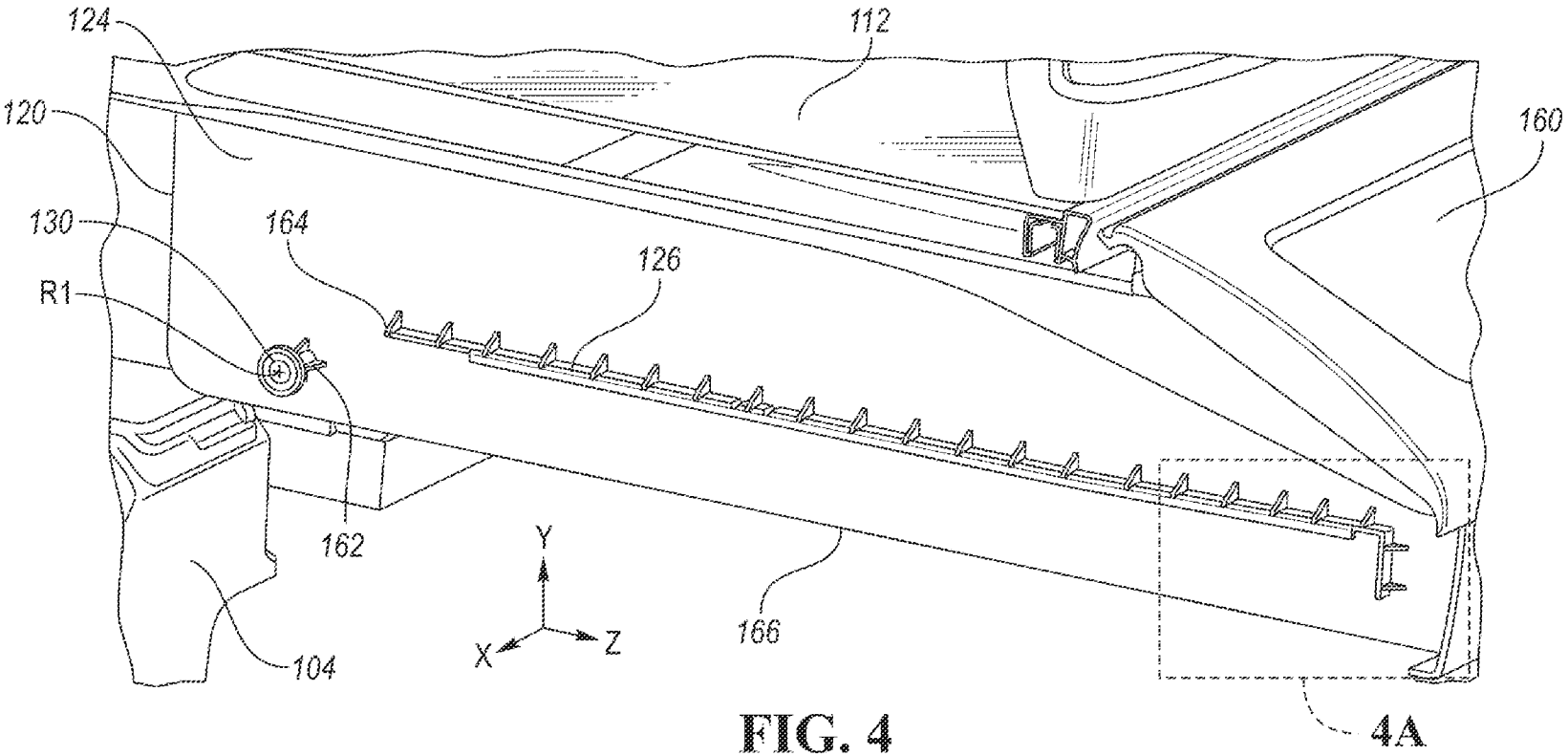
FIG. 4 illustrates a side-perspective view of a portion of the refrigerator including a drawer body.

FIG. 4 illustrates a side-perspective view of a portion of the drawer assembly 110 including the drawer body 116 in the open position. For purposes of clarity, the end cap 132 is not illustrated. As previously mentioned, the drawer body 116 may be disposed above the mullion 104 of the refrigerator 100 and below the lid 112. In one or more embodiments a cover 160 may be fixed to the drawer body 116 such as the flange 154. The first roller 130 may be rotatably fixed to a post 162 that may extend from the sidewall 124 of the drawer body 116. The first roller 130 may be configured to rotate about a first rotational axis R1 as the drawer body moves between the open and closed positions. In one or more embodiments, the first roller 130 and the post 162 may be disposed between a rear distal end 164 of the rail 126 and the rear wall 120 of the drawer body 116 and the first roller 130 may be disposed between a bottom surface 166 of the drawer body 116 and the rail 126.

Figure 4A:
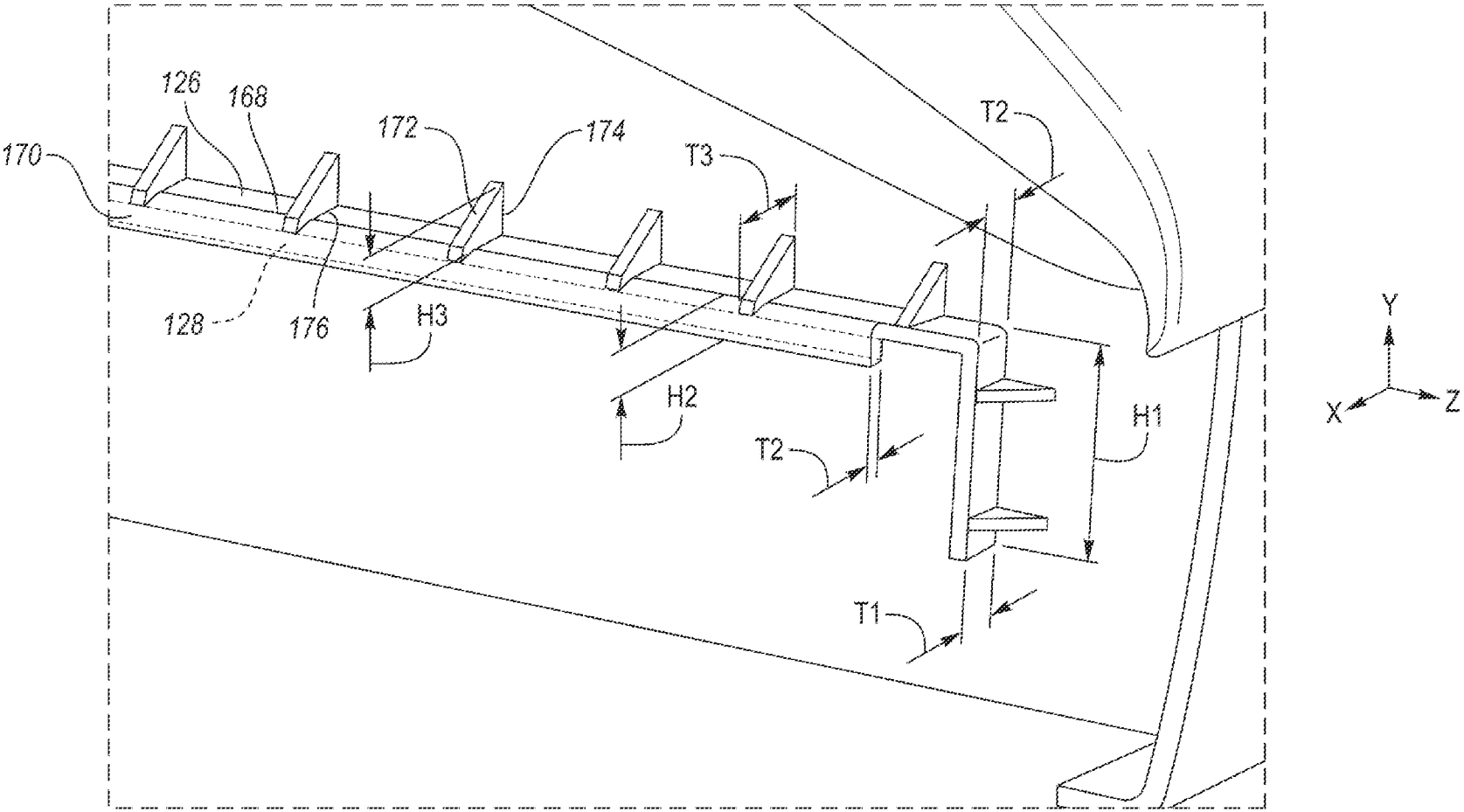
FIG. 4A illustrate a detailed-perspective view of a portion of the drawer body illustrated in FIG. 4

FIG. 4A illustrates a detailed-perspective view of a portion of the drawer body 116 taken along the lines A-A in FIG. 4. In one or more embodiments, the rail 126 may include a rail member 168 and a retaining lip 170 that may extend from the rail member 168, the rail member 168 and the lip 170 may collectively form the channel 128. The lip 170 and the rail member 168 may be arranged to have a substantially L-shaped cross-section. The rail member 168 and the lip may be formed integral to the sidewall 124 by injection molding or another suitable method as required. One or reinforcement members such as stanchions 172 may be provided to support and provided additional stiffness to the rail 126. As an example, the stanchions 172 may have a triangular shape and may include a first face or edge 174, that may be integrally formed or connected to the sidewall 124, and a second face or edge 176 that may be integrally formed or connected to the rail member 168, the lip 170, or both.

As mentioned above, the front distal portion 143 of the rail 126 may form the first stop 144. As an example, the front distal portion 143 may extend from or be continuous with the rail member 168. Accordingly, the size and shape of the front distal portion 143 may be substantially similar to the rail member 168. As an example, the front distal portion 143 may have a first thickness T1 and the rail member 168 may have a second thickness T2. And the first and second thicknesses T1, T2 may be substantially equal to one another. The stanchion 172 may have a third thickness T3 that may be greater than the first thickness T1, the second thickness T2, or both. The front distal portion 143 may extend in the y-direction so that the front distal portion 143 is substantially perpendicular or orthogonal to the rail member 168.

In one or more embodiments, the front distal portion 143 may have a first height H1 and the lip 170 may have a second height H2. The first height H1 of the front distal portion 143 may be sufficiently sized to engage the second roller 140 when the drawer body 116 is in the closed position. The first face 174 of the stanchion 172 may have a third height H3 that may be greater than the second height H2 of the lip 170.

Figure 4B:
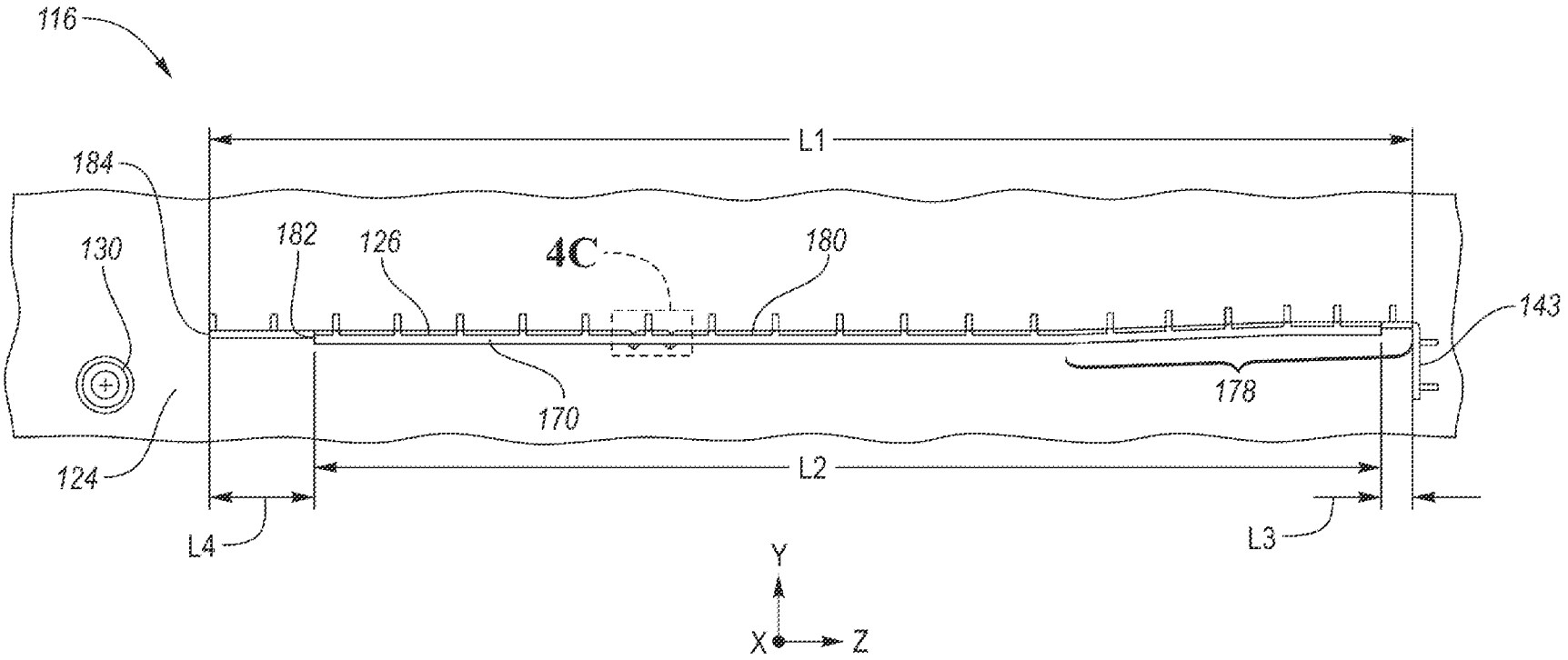
FIG. 4B illustrates a plan-side view of the portion of the drawer body shown in FIG. 4.

FIG. 4B illustrates a plan view of a portion of the drawer body 116. The rail 126 may be formed integral to the sidewall 124 and may have a first length L1 and the lip 170, extending from the rail 126 may have a second length L2 that may be less than the first length L1. The rail 126 may include a number of portions such as the front distal portion 143, an angled portion 178, and a linear portion 180. As an example, the angled portion 178 may extend between the linear portion 180 and the front distal portion 143. In one or more embodiments, a front edge 182 of the lip 170 (FIG. 4A) may be spaced apart from the front distal portion 143 of the rail 126 by a length L3 and a rear edge 182 of the lip 170 may be spaced apart from a rear distal portion 184 of the rail 126 by a fourth length L4. The third length L3 may be less than the fourth length L4. As an example, the fourth length L4 may be four to five times larger than the third length L3.

Figure 4C:
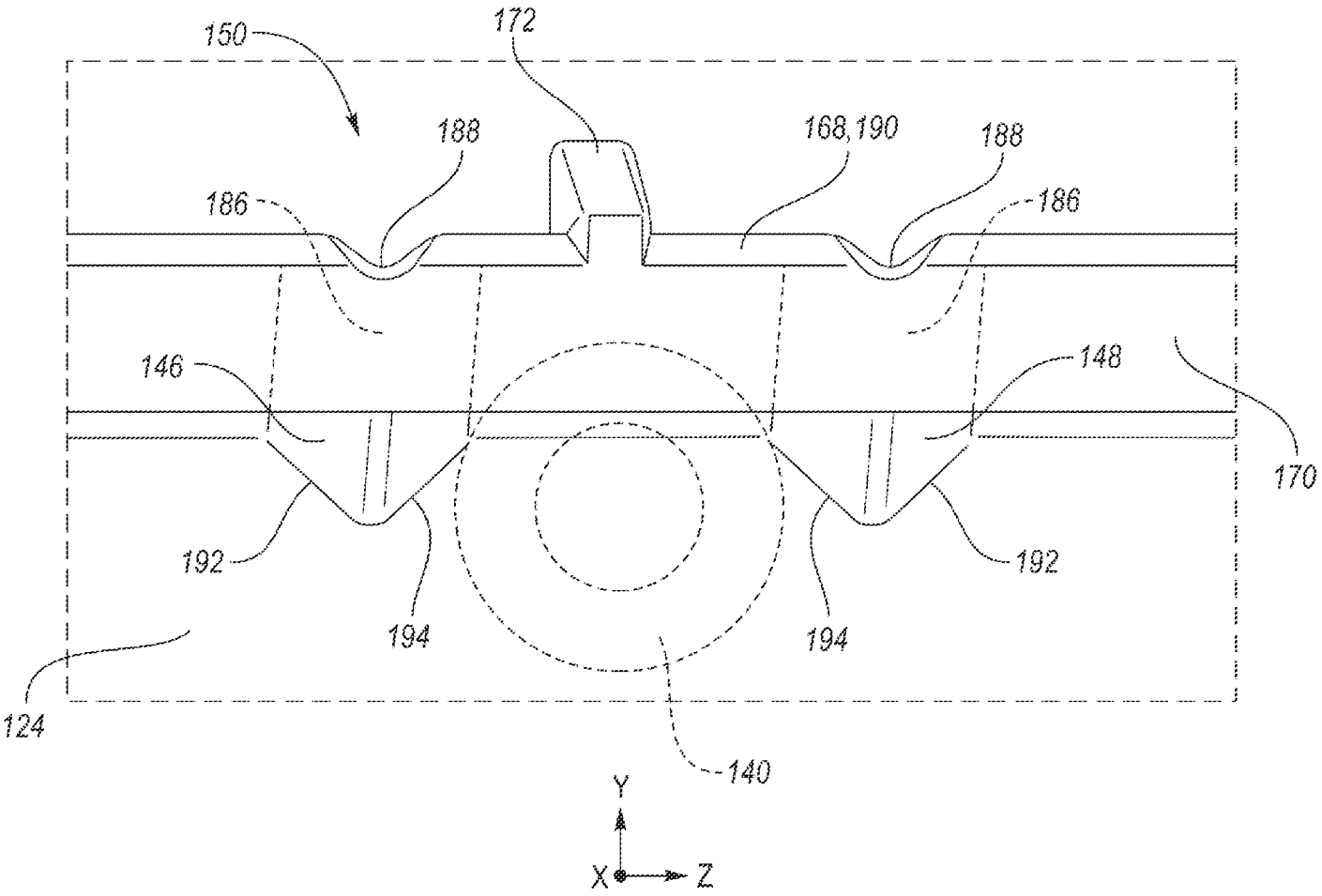
FIG. 4C illustrates a detailed-plan-side view of a portion of the drawer body shown in FIG. 4.

FIG. 4C illustrates a detailed plan view of the second stop 150 taken along lines 4B in FIG. 4. As mentioned above, the second stop 150 may be formed by a number of protrusions, such as the first and second protrusions 146, 148. Portions of the first and second protrusions 146, 148 may be covered by the lip 170. As an example the protrusions 146, 148 may include a main body 186 that may be disposed between the sidewall 124 and the lip 170, as represented by the hidden lines. As an example, the rail member 168 may include a top surface 190 that may define a number of notches 188 that may be formed as the protrusions 146, 148 are formed.

In one or more embodiments, end portions of the first and second protrusions 146, 148 may have a substantially triangular shape. The base of the triangle may extend form the main body 186 below the lip 170. The end portions may include outer faces 192 and inner faces 194. As the drawer body 116 moves in the closing or opening direction, the second roller 140 may engage the outer face 192 until the second roller is disposed between the inner faces 194 to lock the drawer body 116. A user may move the drawer body 116 vertically to disengage the second roller 140 from the inner faces 194 of the first and second protrusions 146, 148.

Figure 5:
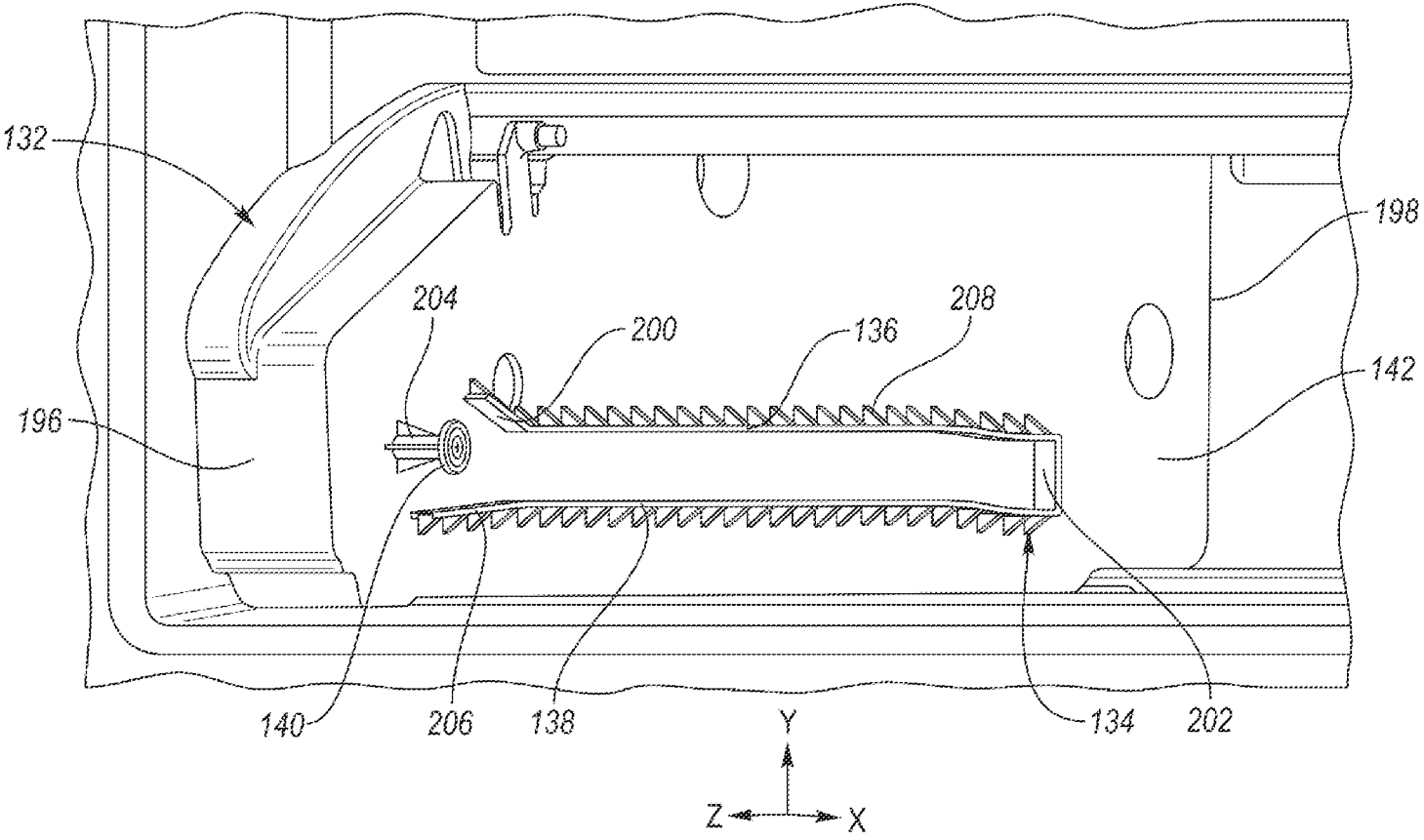
FIG. 5 illustrates a perspective view of a portion of the refrigerator including a first end cap assembly.

FIG. 5 illustrates a perspective view of a portion of the refrigerator 100 including a first end cap 132 or end cap assembly. The first end cap 132 may include a front wall 196, a rear wall 198, and the sidewall 142 may extend therebetween. As mentioned above, the track 134 may include an upper portion 136 and a lower portion 138 that may each be integrally formed, by injection molding or another suitable manufacturing process, to the sidewall 142. A rear end portion of the track 134 may include a vertical wall 202 that may extend between the upper portion 136 and the lower portion 138. A front portion of the track 134 may be opened towards the front wall 196. In one or more embodiments, the upper portion 136 of the track 134 may include an angled portion 200 that extends in a y-z direction and a front portion of the lower portion 138 of the track 134 may extend away from the upper portion 136. These angled portions 200, 206 may installation of the drawer body 116 to the first end cap 132. As an example, the first roller 130 and the rail 126 may be inserted between the upper and lower portions 136, 138 so that the drawer body 116 may move between the open and closed positions.

Figure 6:
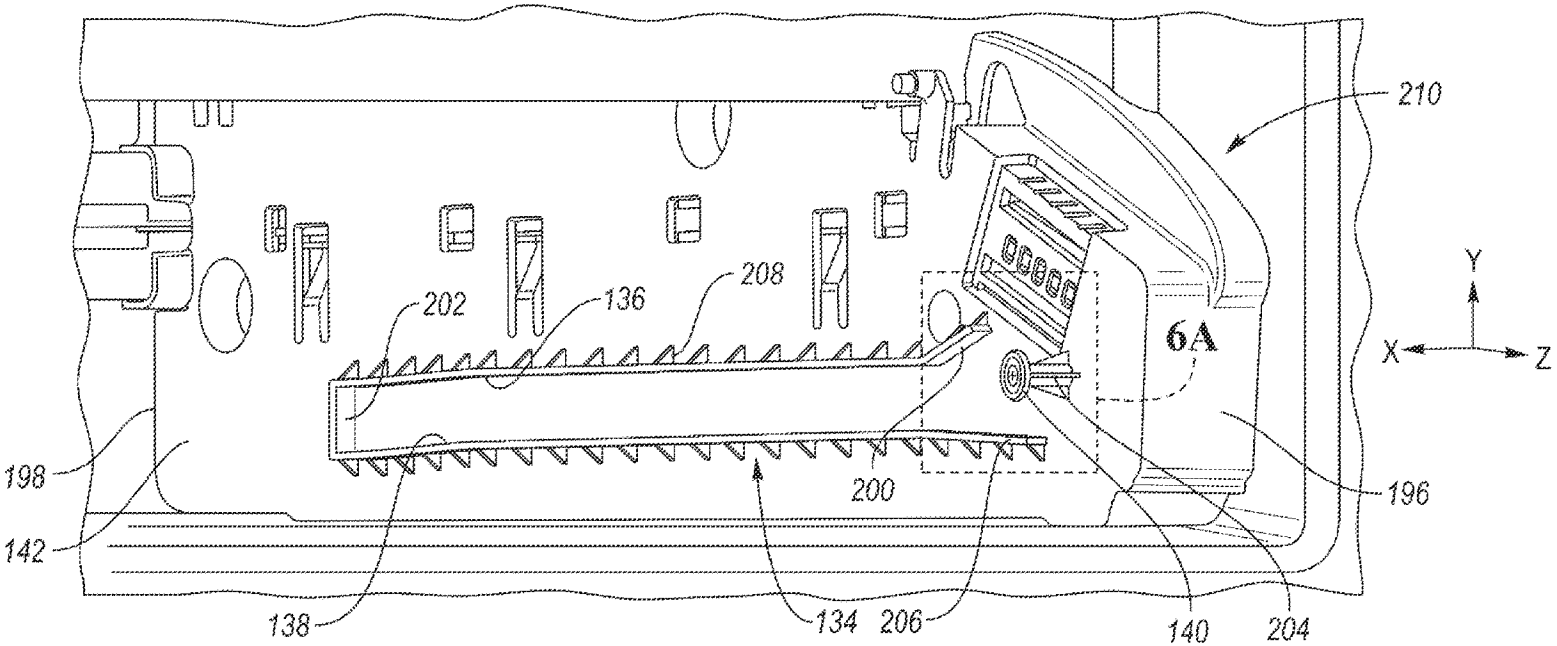
FIG. 6 illustrates a perspective view of a portion of the refrigerator including a second end cap assembly.
Figure 6A:
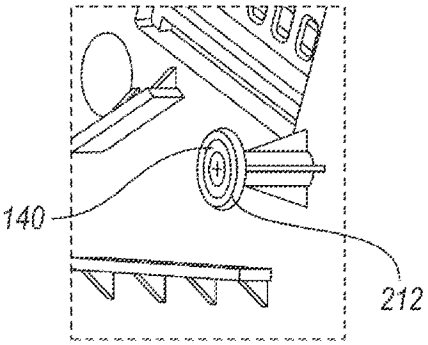
FIG. 6A illustrates a detailed-perspective view taken along the lines 6A in FIG. 6.

FIG. 6 illustrates a perspective view of a portion of the refrigerator 100 including a second end cap 210 or end cap assembly. The second end cap 210 may be substantially similar to the first end cap 132 and may include components of the first end cap 132 that are mirrored with respect to the first end cap 132. Accordingly, the description of those components with common reference numerals as those reference numerals illustrated in FIG. 5 and described above will not be duplicated. FIG. 6A illustrates a detailed perspective view of a portion of the second end cap 210. The first and second end caps or end cap assemblies 132, 210 may each include the second roller 140. In one or more embodiments, the second roller 140 of the first and second end cap assemblies 132, 210 may each include an o-ring 212 that may extend circumferentially around an outer periphery of the second roller 140. As an example, the o-ring 212 may be formed of a relatively soft polymeric or rubber material to provide a smooth rolling action of the drawer body 116 with respect to the first and second end cap assemblies 132, 210.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator drawer assembly comprising:

a drawer body defining a receptacle and including a first side and a second side, wherein the first side and the second side collectively define at least a portion of the receptacle;

a sliding member extending from the first side of the drawer body away from the receptacle, the sliding member including, a first portion extending in a first direction between a rear wall of the drawer body and a front wall of the drawer body, and a lip extending in a second direction, substantially orthogonal to the first direction, from the first portion;

a first roller disposed between the first portion of the sliding member and the rear wall of the drawer body;

an end cap configured to be fixed to an inner wall of a refrigerator and including a front wall, a rear wall, and an inner wall extending therebetween;

a track extending from the inner wall and including, an upper portion and a lower portion, wherein the upper portion and the lower portion each extend in the first direction between the front wall and the rear wall, and the lower portion is configured to carry the first roller;

a second roller fixed to the inner wall of the end cap and configured to rotate, wherein as the drawer is moved in the first direction, the first portion of the sliding member is configured to move along the second roller; and an O-ring disposed on an outer periphery of the second roller.

2. The refrigerator drawer assembly of claim 1, wherein the sliding member includes a second portion extending in the second direction and disposed closer to the front wall of the drawer body than the rear wall of the drawer body, wherein the second portion is configured to engage the second roller when the drawer body is in a fully closed position.

3. The refrigerator drawer assembly of claim 1, wherein the lip is configured such that the lip sandwiches the second roller to the first side of the drawer body to prevent lateral movement of the drawer body as the drawer body moves in the first direction towards an open position.

4. The refrigerator drawer assembly of claim 1, wherein the upper portion of the track is spaced apart from the lower portion to from a vertical stop, wherein the vertical stop is configured to engage the sliding member as the drawer body moves in a second direction, wherein the second direction is substantially orthogonal to the first direction.

5. The refrigerator drawer assembly of claim 1, wherein the track includes an open end and a closed end, and the open end is disposed closer to the front wall than the rear wall.

6. The refrigerator drawer assembly of claim 1, wherein the sliding member is integral with the drawer body.

7. The refrigerator drawer assembly of claim 1, wherein the track is integral with the end cap.

8. A refrigerator drawer assembly comprising:

a drawer body defining a receptacle;

a rail integral with a sidewall of the drawer body and extending in a first direction between a rear wall of the drawer body and a front wall of the drawer body, wherein the rail defines a channel;

a first stop integral with the sidewall of the drawer body;

a first roller disposed between an end of the rail and the rear wall of the drawer body;

an end cap configured to be fixed to an inner liner of a refrigerator and including an inner wall configured to be arranged substantially parallel to the sidewall of the drawer body;

a track extending from the inner wall and including, an upper portion and a lower portion, wherein the upper portion and the lower portion each extend substantially in the first direction; and a second roller fixed to the inner wall of the end cap and configured to rotate, wherein as the drawer body is moved in an opening direction towards a fully open position, the channel is configured to move along the second roller as the second roller rotates, and wherein when the drawer assembly is disposed in the fully open position, the first stop engages the second roller to prevent the drawer body from moving in the first direction beyond the fully open position, wherein the first stop is formed by a number of protrusions extending from the sidewall of the drawer body and disposed within the channel.

9. The refrigerator drawer assembly of claim 8, wherein the rail includes a rail member extending integral with the sidewall of the drawer body and a lip integral with the rail member, wherein the rail member and the lip collectively form the channel.

10. The refrigerator drawer assembly of claim 9, wherein the rail member has a first length and the lip has a second length, wherein the second length is less than the first length.

11. The refrigerator drawer assembly of claim 10, further comprising a second stop disposed closer to the front wall of the drawer body than the second stop, wherein a front distal end of the lip is spaced apart from the second stop.

12. The refrigerator drawer assembly of claim 11, wherein the second stop is formed by a front portion of the rail extending in a vertical direction, wherein the vertical direction extends substantially orthogonally to the first direction.

13. The refrigerator drawer assembly of claim 12, wherein the second stop is configured to engage the second roller when the drawer is in a fully closed position, in which the receptacle is inaccessible.

14. The refrigerator drawer assembly of claim 8, wherein the number of protrusions includes a first protrusion and a second protrusion, wherein a distal portion of at least one of the first protrusion and the second protrusion each have a substantially triangular shape.

15. The refrigerator drawer assembly of claim 14, wherein distal portions of the first protrusion and the second protrusion each have a substantially triangular shape, and first protrusion includes a first inner face and the second protrusion includes a second inner face, wherein the first inner face and the second inner face are configured to sandwich the second roller when the drawer body is in the fully open position.

16. A refrigerator comprising:

an inner liner including a first lateral wall, a second lateral wall, and a rear wall extending therebetween, wherein the inner liner forms a refrigerated compartment the first lateral wall and the second lateral wall are spaced apart from one another in a lateral direction and the rear wall is spaced apart from a front portion of the refrigerated compartment in a depth direction;

an end cap assembly fixed to the inner liner and including:

an inner wall;

a track integral to the inner wall and including an upper portion and a lower portion each extending in the depth direction;

a first roller rotatably fixed to the inner wall;

a drawer body defining a receptacle and configured to move in the depth direction;

a rail integral with a sidewall of the drawer body and extending in in the depth direction and defining a channel, wherein the channel is configured to receive at least portions of the first roller; and a second roller rotatably fixed to the sidewall of the drawer body, wherein the lower portion is configured to support the second roller, wherein the rail forms a rear stop and a front stop and is configured to guide the drawer body along the end cap assembly as the drawer body moves in the depth direction between a fully closed position, in which the front stop engages a portion of the end cap assembly and a fully open position, in which the rear stop engages another portion of the end cap assembly, wherein the front stop is formed by a first protrusion and a second protrusion each extending from the rail in a vertical direction and disposed between a front distal end and a rear distal end of the rail.

17. The refrigerator of claim 16, further comprising:

a number of stanchions having a substantially triangular shape provided with a first edge and a second edge, wherein the first edge is integral to a top surface of the rail and the second edge is integral to the sidewall of the drawer body.

* * * * *